US005128725A

United States Patent [19]

Frankel et al.

[11] Patent Number: 5,128,725

[45] Date of Patent: Jul. 7, 1992

[54] METHOD AND APPARATUS FOR INCREASING TONER LOADING OF A CLEANING BRUSH FOR IMPROVED SURFACE CLEANING IN ELECTROPHOTOGRAPHIC IMAGING

[75] Inventors: Neil A. Frankel, Rochester; Nero R. Lindblad; Larry G. Hogestyn, both of Ontario; Samuel P. Mordenga; Daniel M. Bray, both of Rochester, all of N.Y.

[73] Assignee: Xerox Corporation, Stamford, Conn.

[21] Appl. No.: 569,798

[22] Filed: Aug. 20, 1990

[51] Int. Cl.[5] ..... G03G 21/00

[52] U.S. Cl. ..... 355/301; 15/256.5; 15/256.52; 355/298; 355/302; 118/652

[58] Field of Search ..... 355/296, 297, 298, 301-303, 355/215; 118/652; 430/125; 15/256.52, 256.5

[56] References Cited

U.S. PATENT DOCUMENTS

| | | | |
|---|---|---|---|
| 3,780,391 | 12/1973 | Leenhouts | 15/1.5 |
| 3,807,853 | 4/1974 | Hudson | 355/298 |
| 4,123,154 | 10/1978 | Fisher | 355/303 |
| 4,134,673 | 1/1979 | Fisher | 355/298 |
| 4,435,073 | 5/1984 | Miller | 355/305 |
| 4,639,124 | 1/1987 | Nye, Jr. et al. | 355/297 |
| 4,664,505 | 5/1987 | Itaya et al. | 355/298 |
| 4,673,284 | 6/1987 | Matsumoto et al. | 355/301 |
| 4,706,320 | 11/1987 | Swift | 430/125 X |
| 4,755,853 | 7/1988 | Shimizu | 355/298 |
| 4,761,672 | 8/1988 | Parker et al. | 355/220 |
| 4,819,026 | 4/1989 | Lange et al. | 355/298 |
| 4,870,865 | 9/1989 | Lindblad et al. | 355/296 |
| 4,878,093 | 10/1989 | Edmunds | 355/296 |
| 4,945,388 | 7/1990 | Tange et al. | 355/296 |
| 4,984,028 | 1/1991 | Tonomoto | 355/297 |
| 4,999,679 | 3/1991 | Corbin et al. | 355/303 |

OTHER PUBLICATIONS

Crooks, W. and Wilbur C. V., "Reduction of Toner--filming in Electrophotography", IBM Technical Disclosure Bulletin, vol. 12, No. 12, May 1970, p. 2094.

Crooks, W., "Brush Material for Cleaning Electrophotographic Plates", IBM Technical Disclosure Bulletin, vol. 12, No. 7, Dec. 1969, p. 1046.

*Primary Examiner*—A. T. Grimley
*Assistant Examiner*—Matthew S. Smith
*Attorney, Agent, or Firm*—Mark Costello

[57] ABSTRACT

In an electrostatograhic imaging device of the type forming a multilevel electrostatic latent image on a surface of the imaging member, and developing the multilevel electrostatic latent image with at least two types of toner, and a brush cleaner for removal of toner and debris remaining after transfer of the image to another surface, the brush is maintained in a condition loaded with a first toner type providing abrasive characteristics at the fibers of the brush, for abrading the photoreceptor for removal of toner of said second type.

42 Claims, 3 Drawing Sheets

METHOD AND APPARATUS FOR INCREASING TONER LOADING OF A CLEANING BRUSH FOR IMPROVED SURFACE CLEANING IN ELECTROPHOTOGRAPHIC IMAGING

This invention relates to reproduction apparatus and more particularly to a method and apparatus for improving cleaning with an electrostatic brush cleaner of an imaging surface in electrophotographic applications.

INCORPORATION BY REFERENCE

The following patent documents are incorporated herein by reference for their teachings: U.S. Pat. No. 4,761,672 to Parker et al. and U.S. patent application Ser. No. 07/342,132, filed Apr. 24, 1989, entitled "Process for Forming Two-Color Images", by Koch et al. and assigned to the same assignee as the present application, which show highlight color printing methods and materials.

BACKGROUND OF THE INVENTION

In electrophotographic applications, such as xerography, a charge retentive surface is electrostatically charged and exposed to a light pattern of an original image to be reproduced to selectively discharge the surface in accordance therewith. The resulting pattern of charged and discharged areas on that surface form an electrostatic charge pattern (an electrostatic latent image) conforming to the original image. The latent image is developed by contacting it with a finely divided electrostatically attractable powder referred to as "toner". Toner is held on the image areas by the electrostatic charge on the surface. Thus, the toner image is produced in conformity with the light image of the original being reproduced. The toner image may then be transferred to a substrate such as paper, and the image affixed thereto to form a permanent record of the image to be reproduced. Subsequent to development, excess toner left on the charge retentive surface is cleaned from the surface. The process is well known and useful for light-lens copying from an original and printing applications from an electronically generated or stored original, where a charge surface may be imagewise discharged in a variety of ways. Ion projection devices where a charge is imagewise deposited on a charge retentive substrate operate similarly. In a slightly different arrangement, toner may be transferred to an intermediate surface, prior to retransfer to a final substrate.

Although a preponderance of toner forming the image is transferred to paper during transfer, some toner invariably remains on the charge retentive surface, it being held thereto by relatively high electrostatic and/or mechanical forces. Additionally, paper fibers, Kaolin and other debris have a tendency to be attracted to the charge retentive surface. It is essential for optimum operation that the toner remaining on the surface be cleaned thoroughly therefrom. A commercially successful mode of cleaning employed in automatic electrophotography utilizes a brush with soft conductive or insulative fiber bristles. While the bristles are soft, they are sufficiently firm to remove residual toner particles from the charge retentive surface. In addition to relying on the physical contact of the brush with the surface for the removal of toner, it has been found that establishing an electrostatic field between the charge retentive surface and the cleaning member enhances toner attraction to the cleaning brush fibers. The creation of the electrostatic field between the brush and charge retentive surface is accomplished, in the case of conductive fibers, by applying a D.C. voltage to the brush. When the fibers forming the brush are electrically conductive and a bias is applied thereto, cleaning is observed to be more efficient than if the fibers are non-conductive or insulative. U.S. Pat. No. 4,819,026 to Lange et al. discloses an electrostatic cleaning brush of the type described, to which a bias is applied to conductive fibers to electrostatically enhance cleaning of the charge retentive surface. In the case of insulative fibers, the electrostatic field between the charge retentive surface and the cleaning member is achieved by selecting fibers, flicker bars and toner material that cause the brush to triboelectrically charge to the desired electrical potential.

In certain electrophotographic processes, particularly in highlight color applications that provide two types of toner to develop latent images on a surface, a phenomena of filming is noted. Filming is characterized by the tenacious adherence of very fine material, including toner residues, toner additives (and particularly anti-caking additives), and paper debris to the charge retentive surface. For reasons that are not completely understood, standard conductive and insulative brush cleaners do not provide effective cleaning in systems where a high degree of filming is present. Film cleaning can sometimes be improved in brush cleaners by stiffening the brush fibers, but usually the film remains on the surface. Filming is not noted in association with all toners. Particular toners appear to cause filming, while other toners do not seem to have filming associated with their use. In a particular arrangement, toner filming is noted with the highlight color toner containing anti-caking and other surface additives, described in U.S. patent application Ser. No. 07/342,132 filed Apr. 24, 1989, entitled "Process for Forming Two-Color Images", by Koch et al., but is not noted with the black toner which does not contain any surface additives also described therein. Filming becomes a particular problem when highlight color toner is used for a large proportion of a document, and/or for a large number of copies.

To alleviate the filming problem, an abrasive surface may be used to remove the film. Accordingly, U.S. Pat. No. 4,870,465 to Lindblad et al shows an auger arrangement providing porous foam or poromeric surfaces or surfaces filled with abrasive material for the removal of film buildup. Dual foam rolls with porous surfaces have also been proposed, in U.S. Pat. No. 3,807,853 to Hudson. Poromeric materials tend to collect toner in the pores of the material, which in movement past the charge retentive surface have the tendency to abrade or scour the surface. A light scouring or abrading action is desirable, but too heavy a scouring action will tend to damage coatings on the charge retentive surface. When a foam roll is arranged to provide an adequate cleaning function, it proves to be excessively abrasive, and may damage a soft photoconductive layer on a charge retentive surface. U.S. Pat. No. 4,878,093 to Edmunds shows the combination of a brush and foam roll.

U.S. Pat. No. 4,673,284 to Matsumoto et al. discloses a cleaning device with a rotatable cleaning brush with two types of fibers mounted on a cylindrical core. Among the embodiments shown, are a combination of fibers, of poly-4-fluoroethylene fibers (Teflon) and rayon. U.S. Pat. No. 3,780,391 to Leenhouts shows a cleaning brush fixed in a vacuum chamber, with a flicker bar used to apply a potential to the brush opposite that of residual toner particles which are to be removed from the photoconductive surface. U.S. Pat. No. 4,123,154 to Fisher discloses a cleaning apparatus wherein a flicker element removes residual material from a cleaner element. The flicker element works together with a corona charging device to neutralize toner to aid in removal from a cleaning element. U.S. Pat. No. 4,435,073 to Miller shows a cleaning brush with a plurality of flicker bars, at least one of which is fabricated from a material that will cause the charge on the brush to reverse at least once for every revolution of the brush, such reversal taking place while the brush fibers are subject to a toner removing airflow.

It is known to place a test patch in an interdocument area of the imaging member in an electrostatographic device for the purpose of testing machine operating conditions.

The references cited herein are all incorporated by reference for their teachings.

SUMMARY OF THE INVENTION

In accordance with the invention in an electrostatographic imaging device, there is provided a method and apparatus for increasing the loading of a first type of toner onto the fibers of a cleaning brush, for the purpose of enhancing the abrasion or scavenging of the brush fibers on a charge retentive imaging member surface for improved removal of toner of a second type and debris remaining on the surface after the imaging process.

In accordance with one aspect of the invention, an electrostatographic device of the type contemplated by the present invention includes an arrangement for developing a latent image formed on a charge retentive imaging member surface with two different types of toner material. The first toner material has certain abrasive or scavenging characteristics desirable for abrading or scavenging the surface of the charge retentive member for the enhanced removal of the second type of toner, and filming byproducts thereof. In a desirable cleaning arrangement for removal of toner and debris remaining after transfer on the imaging member surface, a cleaning system similar to that shown in U.S. Pat. No. 4,134,673 to Fisher having a dual brush configuration, and flicker bars arranged around the brush to flick the brush fibers for the release of toner therefrom into an airstream removal arrangement, the flicker bars are made of or coated with a material having an affinity for the collection of the abrasive or scavenging toner. As brush fibers continually come into contact with the toner retaining flicker bars, abrasive or scavenging toner is redeposited onto the brush fibers for a rotation past the flicker bar. With the brush fibers so loaded, the fibers tend to provide an appropriate amount of abrasion or scavenging to the photoreceptor for the removal of fine filming materials.

In accordance with another aspect of the invention, in a cleaning arrangement similar to that previously described, in which at least a first cleaning brush is used for the removing of residual toner and debris from a charge retentive surface in an electrophotographic device of a type in which a latent image is developed with at least two types of toner materials, a first type of toner having abrasive or scavenging characteristics, and the second type of toner having filming characteristics, a significant proportion of fibers of the brush are made from or coated with a material having an affinity for collecting a type of toner having abrasive or scavenging characteristics. As toner is cleaned from the surface, the toner collecting fibers tend to collect the abrasive or scavenging toner, and as the fibers are wiped against the photoreceptor surface, the toner laden fibers provide a significant abrading or scavenging effect suitable for the removal of film material.

In accordance with yet another aspect of the invention, in an electrophotographic device of the type in which a latent image may be developed with two types of toner, a first type of toner having abrasive or scavenging characteristics, and second type of toner having filming characteristics, an excess amount of first type toner is developed onto the imaging member surface, so that the cleaning brush is continually replenished with first type toner having abrasive or scavenging characteristics. As the brush, continuously replenished with first type toner, passes by the surface, the brush fibers, loaded with abrasive or scavenging toner tend to abrade or scavenge the surface to an extent desirable for the removal of film thereon.

In addition to film removal by abrasion, film may be removed from the imaging member surface by bringing toner having a surface with an affinity for collecting the film residue into contact with the film (a scavenging process). Toners formulated without surface additive are known to have an affinity for such additives, and will scavenge such material from the surface of the imaging member. Alternatively, toners that generate a triboelectric charge when contacting the film residue will also serve to scavenge film from the imaging member surface by electrostatic attraction.

These and other aspects of the invention will become apparent from the following description used to illustrate the preferred embodiment of the invention and read in conjunction with the accompanying drawings in which.

Figure 1:
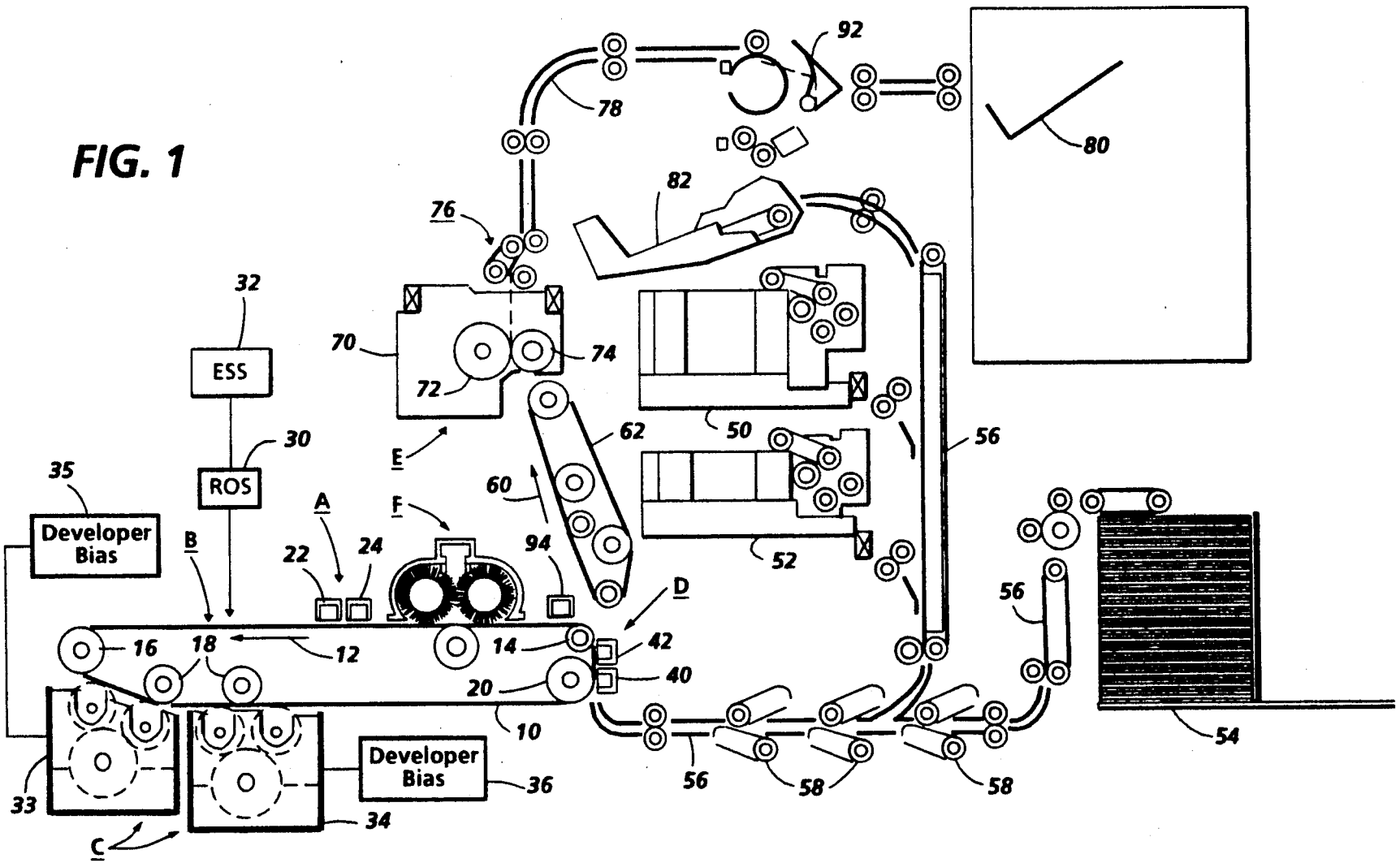
FIG. 1 is a schematic, elevational view depicting an electrophotographic printing machine incorporating the present invention.

Referring now to the drawings wherein the showings are for the purpose of illustrating a preferred embodiment of the invention and not for limiting same, the various processing stations employed in the reproduction machine illustrated in FIG. 1 will be described only briefly. It will no doubt be appreciated that the various processing elements also find advantageous use in electrophotographic copying applications from a hard copy original.

A reproduction machine in which the present invention finds advantageous use utilizes a photoreceptor belt 10 having a charge retentive surface. Belt 10 moves in the process direction of arrow 12 to advance successive portions of the belt sequentially through the various processing stations disposed about the path of movement thereof.

Belt 10 is entrained about stripping roller 14, tension roller 16, idler rollers 18, and drive roller 20. Drive roller 20 is coupled to a motor (not shown) by suitable means such as a belt drive.

Belt 10 is maintained in tension by a pair of springs (not shown) resiliently urging tension roller 16 against belt 10 with the desired spring force. Both stripping roller 14 and tension roller 16 are rotatably mounted. These rollers are idlers which rotate freely as belt 10 moves in the direction of arrow 12.

With continued reference to FIG. 1, initially a portion of belt 10 passes through charging station A. At charging station A, a pair of corona devices 22 and 24 charge photoreceptor belt 10 to a relatively high, substantially uniform negative potential.

At exposure station B, the uniformly charged photoreceptor is exposed to a laser based scanning device 30 or ROS, which, in accordance with a driving ESS 32 or electrostatic subsystem discharges the photoreceptor to one of three charge levels in accordance with a stored image. This records an electrostatic latent image on the belt which corresponds to the informational area contained within electronically stored original information. The ROS could be replaced with an electrophotographic exposure arrangement. A suitable method and apparatus for a multilevel latent image creation, and development with at least two types of toner, may be in accordance with the disclosure of U.S. Pat. No. 4,761,672 to Parker et al.

Thereafter, belt 10 advances the electrostatic latent image to trilevel development station C. At development station C, a pair of magnetic brush developer units 33, 34 each respectively with its own developer bias power supply 35, 36, advances developer mix (i.e. toner and carrier granules) into contact with the electrostatic latent image in accordance with the multi-level latent image, and bias on the developer housing. A suitable developer mix may be in accordance with the disclosure of U.S. patent application Ser. No. 07/342,132, filed Apr. 24, 1989, entitled "Process for Forming Two-Color Images".

Belt 10 then advances the developed latent image to transfer station D. At transfer station D, a sheet of support material such as a paper copy sheet is moved into contact with the developed latent images on belt 10. First, the latent image on belt 10 is exposed to a pre-transfer light from a lamp (not shown) to reduce the attraction between photoreceptor belt 10 and the toner powder image thereon. Additionally a pre-transfer charge leveling corona generating device may be used. Next corona generating device 40 charges the copy sheet to the proper potential so that it is tacked to photoreceptor belt 10 and the toner powder image is attracted from photoreceptor belt 10 to the sheet. After transfer, a corona generator 42 charges the copy sheet to an opposite polarity to detack the copy sheet for belt 10, whereupon the sheet is stripped from belt 10 at stripping roller 14.

Sheets of support material are advanced to transfer station D from supply trays 50, 52 and 54, which may hold different quantities, sizes and types of support materials. Sheets are advanced to transfer station D along conveyor 56 and rollers 58. After transfer, the sheet continues to move in the direction of arrow 60 onto a conveyor 62 which advances the sheet to fusing station E.

Fusing station E includes a fuser assembly, indicated generally by the reference numeral 70, which permanently affixes the transferred toner powder images to the sheets. Preferably, fuser assembly 70 includes a heated fuser roller 72 adapted to be pressure engaged with a back-up roller 74 with the toner powder images contacting fuser roller 72. In this manner, the toner powder image is permanently affixed to the sheet.

After fusing, copy sheets bearing fused images are directed through decurler 76. Chute 78 guides the advancing sheet from decurler 76 to catch tray 80 or a finishing station for binding, stapling, collating etc., and removal from the machine by the operator. Alternatively, the sheet may be advanced to a duplex tray 82 from duplex gate 92 from which it will be returned to the processor and conveyor 56 for receiving second side copy.

A pre-clean corona generating device 94 may be provided for exposing residual toner and contaminants (hereinafter, collectively referred to as toner) to an appropriate polarity of charge to thereby narrow the charge distribution thereon for more effective removal at cleaning station F, more completely described hereinafter. The residual toner remaining on photoreceptor belt 10 after transfer may be reclaimed and returned to the developer station C by any of several well known reclaim arrangements.

As thus described, a reproduction machine in accordance with the present invention may be any of several well known devices. Variations may be expected in specific processing, paper handling and control arrangements without affecting the present invention.

Figure 2:
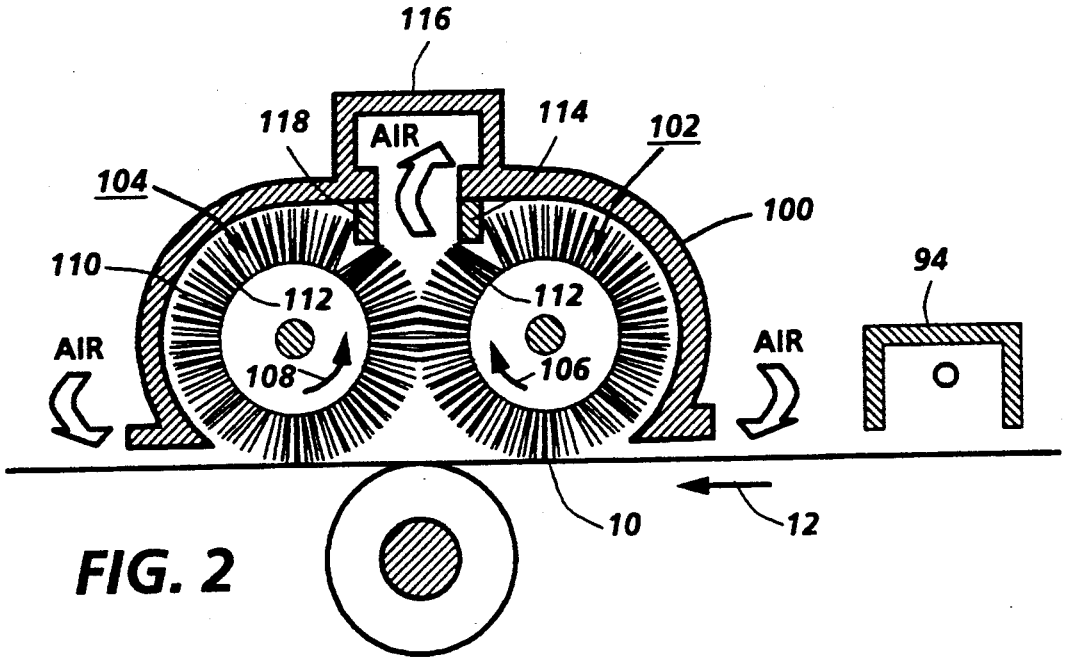
FIG. 2 is a schematic illustration of a cleaning station suitable for use in the electrophotographic printing machine of FIG. 1, and incorporating an embodiment of the invention.

With reference to FIG. 2, slightly downstream from preclean corona generating device 94, cleaning housing 100 supports therewithin two cleaning brushes 102, 104, each supported for counter-rotation with respect to the other (with co-rotation not excluded), in directions 106, 108, respectively, and each supported in cleaning relationship with photoreceptor belt 10. Each brush 102, 104 is generally cylindrical in shape, with a long axis arranged generally parallel to photoreceptor belt 10, and transverse to photoreceptor movement direction 12. Brushes 102, 104 each have a large number of insulative fibers 110 mounted on base 112 each base respectively journaled for rotation (driving elements not shown). The brushes are typically detoned with air moved by a vacuum source (not shown) through the gap between the housing and photoreceptor belt 10, through fibers 110 and exhausting the toner laden air through a channel 116. A typical brush rotation speed is 1300 rpm, and the brush/photoreceptor interference is usually about 2 mm. Brushes 102, 104 beat against the flicker bars 114 and 118, respectively for the release of toner carried by the brushes at or near an entrance to channel 116.

In accordance with one aspect of the invention, flicker bars 114 and 118 are made of Teflon (a trademark of the DuPont Co. for polytetrafluoroethylene) or Teflon-coated material. Teflon flicker bars 114 and 118 have a strong affinity for a first type of toner, herein characterized as black toner. A heavy layer of black toner is formed on the surface of the flicker bars during cleaning of black toner from the photoreceptor 10, and fibers of the brush are noted to become uniformly toner with black toner. While the mechanism for this behavior is not completely understood, it is known that Teflon is very negative in the triboelectric series with respect to most fiber and toner materials, and thus, when in contact with the fibers of the brush, charges negatively to attract positive black toner. This makes toner available for redeposition to the brush during contact. Additionally, the abundance of black toner may cause the brush charge negatively to attract black toner, as the brush fibers are relatively negative with respect to the black toner. It has been observed that in the prior art, where the material Delrin (polyoxymethylene acetal resin) has been used for flicker bars, the Delrin flicker bars do not have an affinity for the black toner, and brushes do not acquire black toner to the extent necessary to provide abrasion of the photoreceptor. The Delrin is not sufficiently negative in the triboelectric series to attract the black toner. Other flicker bar materials or coating that could be substitutes for Teflon in this system are PFA (perfluoroalkoxy), Tefzel (a thermoplastic co-polymer of ethylene and tetrafluroethylene) and other polymer and fluro-polymers in a similar relative position in the triboelectric series with respect to the brush fibers and black toner. In the case of a negative first type toner, the preferred flicker bar materials are very positive in the triboelectric series such as nylon, Lucite (a vinyl polymer of methyl methacrylate) or Acrylon (methyl methacrylate).

Black toner, formulated without surface additives, has the characteristic of being abrasive or scavenging with respect to silicon and stearate type films and other debris adhering to a photoreceptor after transfer and standard cleaning, and noted with use in colored toners on photoreceptor imaging surfaces (hereinafter, film, debris and colored toner will be referred to collectively as "second type toner", or "colored toner").

Figure 3:
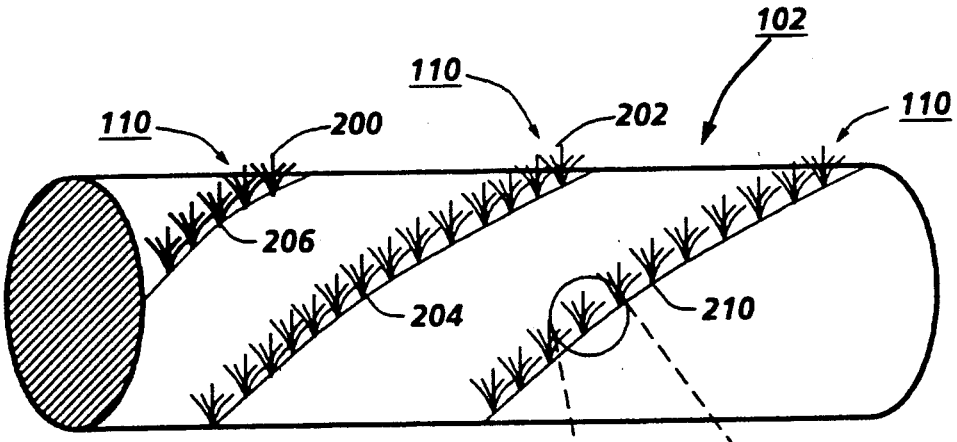
FIGS. 3 and 3A is a somewhat schematic illustration of a cleaning brush suitable for use in the electrophotographic printing machine of FIG. 1, and incorporating an embodiment of the invention.
Figure 3A:
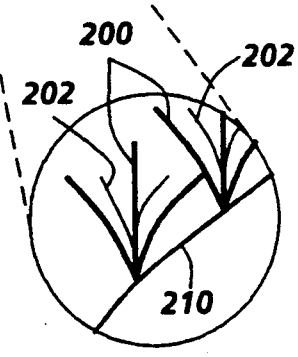

In accordance with another aspect of the invention, irrespective of whether Teflon-coated or Teflon flicker bars are used instead of the more typical Delrin flicker bars, on example cleaning brush 102 cleaning brush fibers 110 may be a combination of Teflon fibers 200 and insulative fibers 202. As shown in FIG. 3, such a brush construction may conveniently include either rows 204, of insulative fibers 202 interspaced with rows 206 of Teflon fibers 200 adjacent to the base fiber row. Alternatively, as shown in detail in FIG. 3A, each tuft 210 of fibers may be a combination of Teflon fibers 200 and base fibers 202, for better support of the Teflon fiber. Combinations of single type fiber rows and combination fiber rows may also be contemplated. The fibers themselves may be either Teflon, or Teflon-coated. In this arrangement, and similar to the arrangement described with respect to FIG. 2, Teflon fibers, tend to have a strong affinity for black toner during the cleaning operation. Despite the vacuum toner removal arrangement shown in FIG. 2, black toner remains adhered to Teflon fibers giving the fibers an abrasive or scavenging nature with respect to colored toner. With the black toner adhering to Teflon fibers, enough abrasion or scavenging is provided for the removal of residual colored toner resulting from the use of colored toners in the electrophotographic process. Again, other materials having an affinity for scavenging or abrasive toner may be used, including PFA (perfluoroalkoxy), Tefzel (a thermoplastic co-polymer of ethylene and tetrafluroethylene) and other polymer and fluro-polymers in a similar relative position in the triboelectric series with respect to the brush fibers and black toner. In the case of a negative first type toner, the preferred fiber material materials are very positive in the triboelectric series such as nylon, Lucite (a vinyl polymer of methyl methacrylate) or Acrylon (methyl methacrylate). Of course, the dual material fiber brush may also be used in combination with the Teflon flicker bar arrangement, described with respect to FIG. 2.

Figure 4:
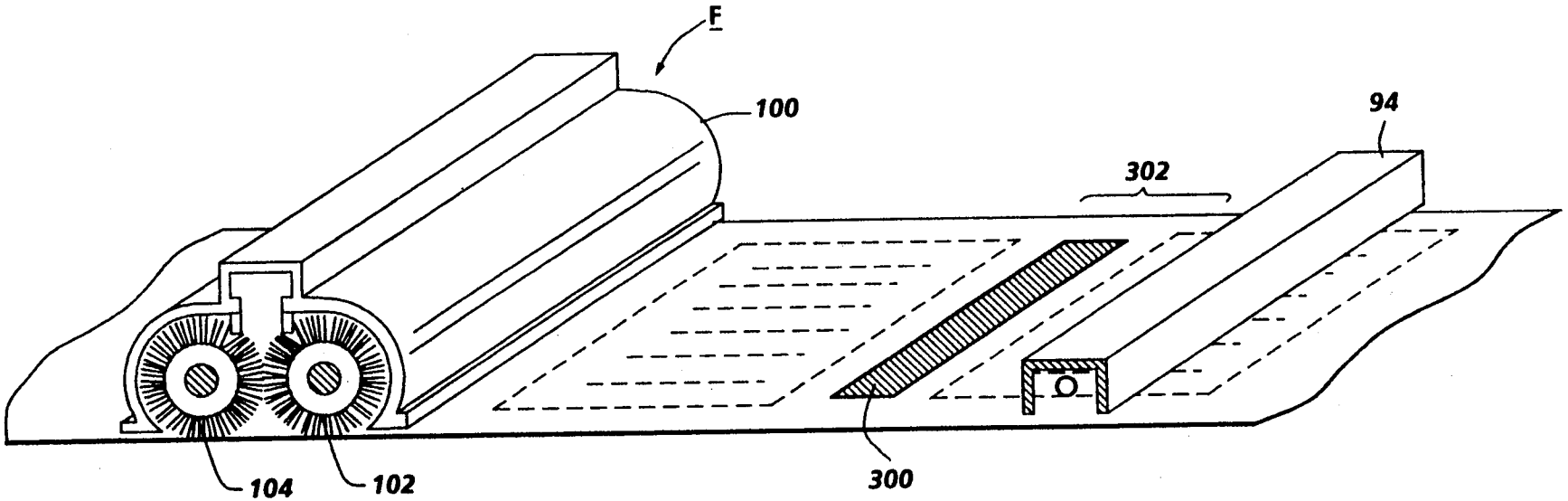
FIG. 4 is a graphic representation of another embodiment of the invention.

In accordance with a further aspect of the invention, as shown in FIG. 4, irrespective of the use of Teflon fibers in the cylindricall cleaning brush as shown in FIG. 3, and irrespective of the use of Teflon or Teflon coated flicker bars, as shown in FIG. 2, the cleaning brushes may be maintained in a toned condition with black toner by providing a periodic black toner stripe 300 in the interdocument zone 302 of the photoreceptor 10. Developmet of black stripe 300 in the interdocument zone, i.e. between document impressions, or when the copier is not making images, creates a supply of black toner in excess to that normally available from residual toner available for toning the fibers of cleaning brushes 102, 104 with black toner. As previously described, by maintaining a supply of black toner on the brush fibers, cleaning of the silicon remaining on the photoreceptor as a result of development with colored toners is improved. Black toner stripe 300 may be formed by a standard method of forming a latent image, and developing the image, as is commonly done for creating a test patch in the interdocument area. The image will not, however, come into contact with a sheet of paper at the transfer station, and thus will remain in place until it is cleaned from the photoreceptor. Alternatively, copying cycles can proceed in which black toner images are made, without transfer.

It will no doubt be appreciated that any or all of the above arrangements for maintainiing the cleaning brushes 102, 104 toned with first type toner may be used alone or in combination. Accordingly, better toning of toner collecting fibers in the cleaning brush may be noted by providing a sump of black toner either on toner collecting flicker bars or in excess toner on the photoreceptor. Additionally while "black toner" and "colored toner" have been described, these terms are used as examples to represent an abrasive or scavenging toner and a filming toner, respectively. It is possible that black filming toners may be found, and that abrasive or scavenging colored toners may be found. Additionally both toners could be black (as, for example, in magnetic and non-magnetic toner printing) or both colored. For the case of films containing primarily residues of toner additives, the abrasive or scavenging toner may typically have little or no surface additives and the filming toner will be formulated with surface additives.

The nature of the cleaning function as "abrasive or scavenging " has been used herein, and in the claims following, as indicative of the cleaning function noted, irrespective of the actual manner in which the toner laden fibers actually remove toner from the imaging member surface.

The invention has been described with reference to a preferred embodiment. Obviously modifications will occur to others upon reading and understanding the specification taken together with the drawings. These embodiments are but examples, and various alternatives, modifications, variations or improvements may be made by those skilled in the art from this teaching which are intended to be encompassed by the following claims.

We claim:

1. In an electrostatographic imaging device having an imaging member moving in a process direction, means for forming a multilevel electrostatic latent image on a surface of the imaging member, means for developing the multilevel electrostatic latent image with at least two types of toner; means for transferring the toner image to a second surface; said first toner type having desirable abrasive or scavenging characteristics, and said scond toner type tending to cause filming on the surface of said imaging member after transfer; and means for cleaning residual toner remaining after tranfer from the imaging member surface, said cleaning means comprising:

at least a first brush cleaner, said first brush cleaner having a large number of fibers arranged thereon for cleaning contact with the imaging member surface for removal of toner therefrom, said fibers collecting toner from the imaging surface during rotation of the brush, and carrying the collected toner to a release position;

toner transport means for removing toner from the fibers of the cleaning brush at the release position; and means for maintaining on said brush an amount of the first toner type providing abrasive or scavenging characteristics to the fibers thereof, for abrading or scavengiing the imaging member surface for removal of toner of said second-type.

2. The device as defined in claim 1 wherein said means for maintaining the first toner type on said brush includes a portion of said number of fibers having an affinity for collecting the first toner type.

3. The device as defined in claim 2, wherein said fibers having an affinity for collecting the first toner type comprised of a fluorinate polymer material.

4. The device as defined in claim 3, wherein said portion of said number of fibers comprise a material selected from the group consisting of polytetrafluroethylene, polyvinylidene fluoride, polyvinyl fluoride, perfluroalkoxy and a thermoplastic copolymer of ethylene and tetrafluroethylene.

5. The device as defined in claim 1 wherein said portion of said number of fibers comprise a material selected from the group consisting of nylon, a vinyl polymer of methyl methacrylate and methyl methacrylate.

6. The device as defined in claim 1, wherein said means for maintaining the first toner type on said brush includes a coating on at least a portion of said number of fibers, said coating on said fibers causing said fibers to have an affinity for collecting the first toner type.

7. The device as defined in claim 6, wherein said coating is made from a material comprising a fluorinated polymer.

8. The device as defined in claim 7, wherein said coating is made from a material selectd from the group consisting of polytetrafluroethylene, polyvinylidene fluoride and polyvinyl fluoride.

9. The device as defined in claim 6, wherein said coating is made from a material selected from the group consisting of nylon, a vinyl polymer or methyl methacrylate and methyl methacrylate.

10. The deviice as defined in claim 1, wherein said means for maintaining the first toner type on said fibers includes a flicker bar arranged adjacent said release position, for toner releasing interference with fibers of the brush cleaner carrying toner to the release position, a surface of said flicker bar contacting said fibers having an affinity for collecting the first type toner..

11. The device as defined in claim 10 wherein said flicker bar has a fiber contacting surface of a fluorinated polymer.

12. The device as defined in claim 10, wherein said brush contacting surface is made of a material selected from the group consisting of polytetrafluroethylene, polyvinylidene fluoride, polyvinyl fluoride, perfluroalkoxy and a thermoplastic copolymer of ethylene and tetrafluoroethylene.

13. The device as defined in claim 10 wherein said brush contacting surface is made of a material selected from the group consisting of nylon, a vinyl polymer of methyl methacrylate and methyl methacrylate.

14. In an electrostatographic imaging device having an imaging member moving in a process direction, means for forming a multilevel electrostatic latent image on a surface of the imaging member, means for developing the multilevel electrostatic latent image with at least two types of toner; means for transferring the toner image to a second surface; said first toner type having desirable abrasive or scavenging characteristics, and said second toner type tending to cause filming on the surface of said imaging member after transfer; and means for cleaning residual toner remaining after transfer from the imaging member surface, said cleaning means comprising:

at least a first brush cleaner, said first brush cleaner having a large number of fibers arranged thereon for cleaning contact with the imaging member surface for removal of toner therefrom, said fibers collecting toner from the imaging surface during rotation of the brush, and carrying the collected toner to a release position;

toner transport means for removing toner from the fibers of the cleaning brush at the release position;

means for maintaining on said brush an amount of the first toner type providing abrasive or scavenging characteristics to the fibers thereof, for abrading or scavenging the imaging member surface for removel of toner of said second type; and wherein said means for maintaining the first toner type on said fibers includes means for depositing an extra supply of first type toner in a non-imaged area of said imaging member surface, whereby fibers of the cleaning brush collect first type toner, irrespective of any amount used in developing the multilevel electrostatic latent image.

15. The device as defined in claim 14, wherein said means for depositing an extra supply of first type toner in a non-imaged area of said imaging member surface includes means to form an electrostatic latent image in a non-imaged area developable by the developing means primarily with first type toner.

16. In an electrostatic imaging device having an imaging member moving in a process direction, means for forming a multilevel electrostatic latent image on a surface of the imaging member, means for developing the multilevel electrostatic latent image with at least two types of toner; means for transferring the toner image to a second surface; said first toner type having desirable abrasive or scavenging characteristics, and said second toner type tending to cause filming on the surface of said imaging member after transfer; and means for cleaning residual toner remaining after transfer from the imaging member surface, said cleaning means comprising:

at least a first brush cleaner, said first brush cleaner having a large number of fibers arranged thereon for cleaning contact with the imaging member surface for removal of toner therefrom, said fibers collecting toner from the imaging surface during rotation of the brush, and carrying the collected toner to a release position;

toner transport means for removing toner from the fibers of the cleaning brush at the release position;

means for maintaining on said brush an amount of the first toner type providing abrasive or scavenging characteristics to the fibers thereof, for abrading or scavenging the imaging member surface for removal of toner of said second type; and wherein said means for maintaining the first toner type on said fibers includes means for depositing an extra supply of first type toner on the imaging member surface, whereby fibers of the cleaning brush collect first type toner, irrespectiive of any amount used in developing the multilevel electrostatic latent image.

17. In an electrostatographic imaging device having an imaging member moving in a process direction, means for forming a multilevel electrostatic latent image on a surface of the imaging member, means for developing the multilevel electrostatic latent image with at least two types of toner; means for transferring the toner image to a second surface; said first toner type having desirable abrasive or scavenging characteristics, and said second toner type tending to cause filming on the surface of said imaging member after transfer; and means for cleaning residual toner remaining after transfer from the imaging member surface, said cleaning means comprising:

at least a first brush cleaner, said first brush cleaner having a large number of fibers arranged thereon for cleaning contact with the imaging member surface duriing rotating motion of the brush cleaner for removal of toner therefrom, said fibers collecting toner from the imaging surface and carrying the collected toner to a release position;

said brush fibers having a portion of the number thereof made of an insulating material, and a portion of the number thereof made from a material having an affinity for collecting first type toner, the insulating material fibers and the toner collecting fibers interspersed generally uniformly through the brush, to allow collection of first type toner thereby; and toner transport means for removing the preponderance of toner from the fubers of the cleaning brush at the release position, said fibers retaining after toner removal therefrom an amount of toner sufficient to abrade or scanvenge the imaging member surface for enhanced second type toner collection.

18. The device as defined in claim 17, wherein said toner collecting fibers have a coating thereon an affinity for collecting first toner type.

19. The device as defined in claim 18, wherein said material having an affinity for collecting first type toner is a fluorinated polymer.

20. The device as defined in claim 18, wherein said material having an affinity for collecting first type toner is selected from the group consisting of polytetrafluroethylene, polyvinylidene fluoride, polyvinyl fluoride, perfluroalkoxy and a thermoplastic copolymer of ethylene and tetrafluoroethylene.

21. The device as defined in claim 18 wherein said material having an affinity for collecting first type tone is selected from the group consisting of nylon, a vinyl polymer of methyl methacrylate and methyl methacrylate.

22. The device as defined in claim 17, wherein said material having an affinity for collecting first type toner is a fluorinated polymer.

23. The device as defined in claim 17, wherein said material having an affinity for collecting first type toner is selected from the group consisting of polytetrafluroethylene, polyvinylidene fluoride, polyvinyl fluoride,-perfluoroalkoxy and a thermoplastic copolymer of ethylene and tetrafluroethylene.

24. The device as defined in claim 17 wherein said material having an affinity for collecting first type toner is selected from the group consisting of nylon, a vinyl polymer of methyl methacrylate and methyl methacrylate.

25. The device as defined in claim 17, further including:

means for releasing toner from said brush at said release position, said releasing means including a flicker bar arranged adjacent said release position, for toner releasing interference with toner-carrying fibers moving therepast, a surface of the flicker bar contacting said fibers having an affinity for collecting the first type toner.

26. The device as defined in claim 25 wherein said flicker bar has a brush contacting surface of a fluorinated polymer.

27. The device as defined in claim 25, wherein said brush contacting surface of said flicker bar is a material is selected from the group consisting of polytetrafluroethylene, polyvinylidene fluoride, polyvinylfluoride, perfluroalkoxy and thermoplastic copolymer of ethylene and tetrafluroethylene.

28. The device as defined in claim 25 wherein said brush contacting surface is made of a material selected from the group consisting of nylon, a vinyl polymer of methyl methacrylate or methyl methacrylate.

29. In an electrostatic imaging device having an imaging member moving in a process direction, means for forming a multilevel electrostatic latent image on a surface of the imaging member, means for developing the multilevel electrostatic latent image with at least two types of toner; means for transferring the toner image to a second surface; said first toner type having desirable abrasive or scavenging characteristics, and said second toner type tending to cause filming on the surface of said imaging member after transfer; and means for cleaning residual toner remaining after transfer from the imaging member surface, said cleaning means comprising:

at least a first brush cleaner, said first brush cleaner having a large number of fibers arranged thereon for cleaning contact with the imaging member surface during rotating motion of the brush cleaner for removal of toner therefrom, said fibers collecting toner from the imaging surface and carrying the collected toner to a release posiion;

said brush fibers having a portion of the number thereof made of an insulating material, and a portion of the number thereof made from a material having an affinity for collecting first type toner, the insulating material fibers and the toner collecting fibers interspersed generally uniformly through the brush, to allow collection of first type toner thereby;

toner transport means for removing the preponderance of toner from the fibers of the cleaning brush at the release position, said fibers retaining after toner removal therefrom an amount of toner sufficient to abrade or scavenge the imaging member surface for enhanced second type toner collection; and means for depositing an extra supply of first type toner in a non-imaged area of said imaging member surface, whereby fibers of the cleaning brush collect first type toner, irrespective of any amount used in developing the multilevel electrostatic latent image.

30. In an electrostatographic imaging device having an imaging member moving in a process direction, means for forming a multilevel electrostatic latent image on a surface of the imaging member, means for developing the multilevel electrostatic latent image with at least two types of toner, means for transferring the toner image to a second surface; said first toner type having desirable abrasive or scavenging characteristics, and said second toner type tending to cause filming on the surface of said imaing member after transfer; and means for cleaning residual toner remaining after transfer from the imaging member surface, said cleaning means comprising:

at least a first brush cleaner, said first brush cleaner having a large number of fibers arranged thereon for cleaning contact with the imaging member surface during rotating motion of the brush cleaner for removal of toner therefrom, said fibers collecting toner from the imaging surface and carrying the collected toner to a release position;

said brush fibers having a portion of the number thereof made of an insulating material, and a portion of the number thereof made from a material having an affinity for collecting first type toner, the insulating material fibers and the toner collecting fibers interspersed generally uniformly through the brush, to allow collection of first type toner thereby;

toner transport means for removing the preponderance of toner from the fibers of the cleaning brush at the release position, said fibers retaining after toner removal therefrom an amount of toner sufficient to abrade or scavenge the imaging member surfaace for enhanced second type toner collection; and means for maintaining the first toner type on said fibers including means for depositing an extra supply of first type toner on the imaging member surface, whereby fibers of the cleaning brush collect first type toner, irrespective of any amount used in developing the multilevel electrostatic latent image.

31. In an electrostatic imaging device having an imaging member moving in a process direction, means for forming a multilevel electrostatic latent image on a surface of the imaging member, means for developing the multilevel electrostatic latent image with at least two types of toner; means for transferring the toner image to a second surface; said first toner type having desirable abrasive or scavenging characteristics, and said second toner type tending to cause filming on the surface of said imaging member after transfer; and means for cleaning residual toner remaining after transfer from the imaging member surface, said cleaning means comprising:

at least a first brush cleaner, said first brush cleaner having a large number of fibers arranged thereon for cleaning contact during relative motion with the imaging member surface for removal of toner therefrom, said fibers collecting toner from the imaging surface and carrying the collected toner to a release position;

said fibers having abrading or scavenging characteristics for removal of second type toner from the imaging member surface when loaded with first type toner;

toner transport means for removing toner from the fibers of the cleaning brush at the release position; and means for depositing an excess amount of first type toner on the imaging member surface, whereby fibers of the cleaning brush collect first type toner, irrespective of any amount used in developing the multilevel electrostatic latent image.

32. The device as defined in claim 31, wherein said means for depositing an extra supply of first type toner on said imaging member surface includes means to form an electrostatic latent image in a non-imaged area developable by the developing means primarily with first type toner.

33. The device as defined in claim 31, wherein said number of brush fibers have a portion thereof made of an insulating material, and a portion thereof made from a material having an affinity for collecting first type toner, the insulating material fibers and the toner collecting fibers interspersed through the brush, to allow uniform collection of first type toner thereby.

34. The device as defined in claim 33, wherein said material having an affinity for collecting first type toner is a fluorinated polymer.

35. The device as defined in claim 33, wherein said material having an affinity for collecting first type tone is selected from the group consisting of polytetrafluroethylene, polyvinylidene fluoride, and polyvinyl fluoride.

36. The device as defined in claim 33 wherein said material having an affinity for collecting first type tone is selected from the group consisting of nylon, a vinyl polymer of methyl methacrylate or methyl methacrylate.

37. The device as defined in claimi 31, further including:

means for releasing toner from said brush at said release position including a flicker bar arranged adjacent said release position, for toner releasing interference with fibers of the brush cleaner carrying toner to the release position, a surface of the flicker bar contacting said fibers having an affinity for collecting the first type toner.

38. The device as defined in claim 37 wherein said fiber contacting surface of said flicker bar is a fluorinated polymer.

39. The device as defined in claim 37, wherein said brush contacting surface is selected from the group consisting of polytetrafluroethylene, polyvinylidene fluoride, polyvinyl fluoride, perfluroalkoxy and a thermoplastic copolymer of ethylene and tetrafluroethylene.

40. The device as defined in claim 37 wherein said brush contacting surface is made of a material selected from the group consisting of nylon, a vinyl polymer of methyl methacrylate or methyl methacrylate.

41. In an electrostatographic imaging device having an imaging member moving in a process direction, means for forming a multilevel electrostatic latent image on a surface of the imaging member, means for developing the multilevll electrostatic latent image with at least two types of toner; means for transferring the toner image to a second surface; said first toner type having desirable abrasive characteristics, and said second toner type tending to cause filming on the surface of said imaging member after transfer; and means for cleaning residual toner remaining after transfer from the imaging member surface, said cleaning means comprising:

a fiber brush cleaner, including two generally cylindrical brushes journaled for rotation about an axis generally parallel to the imaging member surface, and generally transverse to the process direction, each brush having a large number of fibers arranged thereon for cleaning contact during relative motion with the imaging member surface for removal of toner therefrom, said fibers collecting toner from the imaging surface and carrying the collected toner to a release position;

said fibers having abrading or scavenging characteristics for removal of second type toner from the imaging member surface when loaded with first type toner;

means for maintaining loading of said brush fiber with first type toner; and toner transport means for removing toner from the fibers of the cleaning brush at the release position.

42. In an electrostatographic imaging device having an imaging member moving in a process direction, means for forming a multilevel electrostatic latent image on a surface of the imaging member, means for developing the multilevel electrostatic latent image with at least two types of toner; means for transferring the toner image to a second surface; said first toner type having desirable abrasive or scavenging characteristics, and said second toner type tending to cause filming on the surface of said imaging member after transfer; and means for cleaning residual toner remaining after transfer from the imaging member surface, said cleaning means comprising:

a brush cleaner, having a large number of fibers arranged thereon for cleaning contact with the imaging member surface of removal of toner therefrom, said fibers collecting toner from the imaging surface during rotation of the brush, and carrying the collected toner to a release position;

said fibers made of a material which is relatively negative in triboelectrical properties with respect to said said first type toner, whereby during contact therebetween, a negative charge is acquired by the fibers;

said negatively charged fibers having an affinity for collecting first type toner, and acquiring abrading or scavenging characteristics for removal of second type toner from the imaging member surface when loaded with first type toner.

* * * * *